US005785635A

United States Patent [19]

Gerschefske et al.

[11] Patent Number: 5,785,635

[45] Date of Patent: *Jul. 28, 1998

[54] MULTIPLE FUNCTION EXERCISE APPARATUS

[75] Inventors: Kevin Gerschefske; Rick Byrd, both of Springfield; William C. Brazeal, Mansfield, all of Mo.

[73] Assignee: Stamina Products, Inc., Springfield, Mo.

[ * ] Notice: The term of this patent shall not extend beyond the expiration date of Pat. No. 5,419,751.

[21] Appl. No.: 492,952

[22] Filed: Jun. 21, 1995

Related U.S. Application Data

[63] Continuation of Ser. No. 150,469, Nov. 10, 1993, abandoned, which is a continuation-in-part of Ser. No. 14,495, Oct. 22, 1993, Pat. No. Des. 359,325, and a continuation-in-part of Ser. No. 145,202, Oct. 28, 1993, Pat. No. 5,419,751, which is a continuation-in-part of Ser. No. 5,544, Mar. 5, 1993, Pat. No. Des. 352,536.

[51] Int. Cl.[6] ..... A63B 21/04; A63B 21/008

[52] U.S. Cl. ..... 482/133; 482/112; 482/129; 482/130; 482/133; 482/138

[58] Field of Search ..... 482/100, 112, 482/113, 129, 130, 137, 138, 62, 72

[56] References Cited

U.S. PATENT DOCUMENTS

| | | | |
|---|---|---|---|
| Re. 28,066 | 7/1974 | Macryan . | |
| D. 263,978 | 4/1982 | Brentham . | |
| D. 296,709 | 7/1988 | Gvoich et al. . | |
| D. 303,558 | 9/1989 | Alessandri . | |
| D. 324,710 | 3/1992 | Habing . | |
| D. 329,477 | 9/1992 | Lehtonen . | |
| D. 330,238 | 10/1992 | Desiderio . | |
| 3,116,062 | 12/1963 | Zinkin . | |
| 3,708,167 | 1/1973 | Potgieter . | |
| 4,072,309 | 2/1978 | Wilson . | |
| 4,422,636 | 12/1983 | D Angeli . | |
| 4,429,871 | 2/1984 | Flechner | 482/138 X |
| 4,492,375 | 1/1985 | Connelly . | |
| 4,509,745 | 4/1985 | Angsten | 482/113 X |
| 4,563,001 | 1/1986 | Terauds . | |
| 4,582,320 | 4/1986 | Shaw . | |
| 4,600,189 | 7/1986 | Olschansky et al. . | |
| 4,606,540 | 8/1986 | Chin-Sen . | |
| 4,614,338 | 9/1986 | Castillo . | |
| 4,618,144 | 10/1986 | Gibson . | |

(List continued on next page.)

FOREIGN PATENT DOCUMENTS

| | | |
|---|---|---|
| 2524329 | 10/1983 | France . |
| 8005681 | 10/1980 | Netherlands . |

OTHER PUBLICATIONS

Flex CTS Cross Training System Owner's Manual, Mar. 1990.

AMF American Retail products 1983 Brochure pp. 8–11.

*Primary Examiner*—Richard J. Apley
*Assistant Examiner*—John Mulcahy
*Attorney, Agent, or Firm*—Kokjer, Kircher, Bowman & Johnson

[57] ABSTRACT

An exercise machine has a first bar releasably coupled with a first cam pivotally mounted generally above and behind a seat mounted on the frame of the exercise machine. A second bar is connected to an arm assembly which is releasably coupled to a second cam pivotally mounted generally below the seat. Each cam has a means for resisting rotation of the cam mounted between it and the frame. Movement of either the first bar or second bar rotates its associated cam against the resistance of its associated resistance means. The starting position of each bar is adjustable and may be selected by coupling the bar with its associated cam in one of a plurality of fixed resting positions. Each cam may rotate in either direction about its pivot position. Accordingly, each bar may be moved from its selected starting rest position in either direction to impart rotation of its associated cam against selected resistance. In one embodiment, the resistance means are such that returning the bar to its starting position is also against resistance.

26 Claims, 7 Drawing Sheets

U.S. PATENT DOCUMENTS

| | | | |
|---|---|---|---|
| 4,623,144 | 11/1986 | Rockwell | 482/137 |
| 4,627,614 | 12/1986 | De Angeli . | |
| 4,640,268 | 2/1987 | Roberts . | |
| 4,709,920 | 12/1987 | Schnell . | |
| 4,721,303 | 1/1988 | Fitzpatrick . | |
| 4,722,525 | 2/1988 | Brentham | 482/113 X |
| 4,763,897 | 8/1988 | Yakata . | |
| 4,792,135 | 12/1988 | Chin-Sen . | |
| 4,834,367 | 5/1989 | Salyer et al. . | |
| 4,893,812 | 1/1990 | Dawson, Jr. et al. . | |
| 4,900,018 | 2/1990 | Ish, III et al. . | |
| 4,915,377 | 4/1990 | Malnke et al. . | |
| 4,940,233 | 7/1990 | Bull et al. | 482/112 |
| 4,964,632 | 10/1990 | Rockwell . | |
| 4,979,736 | 12/1990 | Maynard | 482/113 X |
| 4,986,538 | 1/1991 | Ish, III . | |
| 5,004,224 | 4/1991 | Wang . | |
| 5,080,351 | 1/1992 | Rockwell . | |
| 5,135,451 | 8/1992 | Chen . | |
| 5,236,406 | 8/1993 | Webber . | |
| 5,277,684 | 1/1994 | Harris | 482/130 |
| 5,308,304 | 5/1994 | Habing | 482/100 X |
| 5,370,595 | 12/1994 | Voris et al. | 482/100 |
| 5,423,731 | 6/1995 | Chen | 482/72 |

MULTIPLE FUNCTION EXERCISE APPARATUS

This application is a continuation of Ser. No. 08/150,469 filed Nov. 10, 1993, now abandoned; which is a continuation-in-part of Ser. No. 29/014,495 filed Oct. 22, 1993, now U.S. Pat. No. D-359,325 issued Jun. 13, 1995; and is a continuation-in-part of Ser. No. 08/145,202 filed Oct. 28, 1993, now U.S. Pat. No. 5,419,751 issued May, 30, 1995; which is a continuation-in-part of Ser. No. 29/005,544 filed Mar. 5, 1993, now U.S. Pat. No. D-352,536 issued Nov. 15, 1994.

BACKGROUND OF THE INVENTION

1. Field of the Invention

The present invention relates in general to an exercise apparatus. Particularly, the present invention relates to an improved exercising machine having components for the performance of multiple physical exercises.

2. Description of the Related Art

The variety of weight-training devices available today is a tribute to the increasingly recognized importance and popularity of physical fitness. In response to the growing demand for exercise machines capable of performing a variety of functions, many types of multiple function exercise devices have been developed which have components for the performance of a variety of physical exercises.

Many exercising devices of the foregoing type are large cumbersome machines having individual stations for the performance of different exercises. The overall size and the number of components used in these types of machines makes them costly, largely inappropriate for use in many areas, and additionally, makes their transportation, once assembled, difficult. Many efforts have been made to reduce the size of multi-function exercise devices, often resulting in exercise machines which sacrifice the machine's ability to afford a complete workout.

Further, prior art machines are typically encumbered with one or more of a variety of complicated arrangements for coupling a lifting mechanism to a stack of weights or other resistance means. Traditionally, as the number of possibilities for performing exercises on an exercise machine increased, the number of components necessary to complete the machine also increased, thereby resulting in a costlier, heavier, more spacious and complex exercising device.

Additionally, properly performing a physical exercise depends in large part upon the proper positioning of the individual during the performance of the exercise, and upon appropriate motion of the individual's body and appendages required to be used for the particular exercise being performed. Moreover, it has become well-recognized that an overall physical conditioning program includes, in addition to adequate rest and proper nutrition, a variety of factors such as flexibility, cardiovascular training, and strength training. In this regard, prior art exercise machines do not provide the ability for a user to effectively utilize the same components of the machine in one mode of operation for achieving aerobic exercising benefits and in a second mode of operation for achieving anaerobic benefits. The present invention meets this previously unfilled need.

Accordingly, the need exists for a multi-function exercise apparatus that facilitates proper performance of a variety of physical exercises and for permitting the user to achieve the advantages of weight training, aerobic training, and flexibility, in a weight training device having relatively few components. Additionally, the need exists for an exercise machine that is easily converted by the user from one mode of operation to a second mode of operation. Further still, the need exists for an exercise machine which permits the performance of a variety of physical exercises without the presence of numerous moving parts, complex links, pulleys, and other components as commonly found in the prior art. The present invention fills these and other needs by providing a multiple function exercise machine that permits the proper performance of a variety of physical exercises with a minimal number of components.

SUMMARY OF THE INVENTION

An overall object of the present invention is to provide an inexpensive and efficient exercise machine for performing multiple physical exercises.

Another object of the present invention is to provide an exercise machine which is designed to improve the user's strength, flexibility, and cardiovascular fitness.

Another object of the present invention is to provide a multiple-function exercise machine which is easy to convert from one mode of operation to another mode of operation.

Still another object of the present invention is to provide an exercise machine which permits the user to perform of a variety of exercises with the same components of the machine.

Another principle object of the present invention is to provide a machine with a relatively small number of components for performing a variety of weight-lifting exercises.

Another object of the present invention is to provide a multi-function exercise apparatus whereby rotational movement of a pivotal cam in either a first or second direction during the performance of weight-lifting exercises actuates a resistance assembly.

Another object of the present invention is to provide a multi-function exercise apparatus which is well adapted to provide both anaerobic and aerobic physical conditioning.

These and other objects are achieved by a cam pivotally mounted to the frame of an exercise machine whereby the cam is free to rotate about its pivot position in either a clockwise or counter-clockwise direction. Means, for resisting rotational movement of the cam, is connected between the cam and the frame. Such means may include a piston, elastomeric straps or bands, the more traditional cable and weight assembly, resistance means utilizing electromagnetics, or other forms of resistance.

An element, such as a bar for engaging by the user while performing exercises, is pivotally coupled to the cam. The starting position of the bar used for performing exercises is adjustable and may be selected by the user in accordance with the exercise desired to be performed. This is accomplished by aligning a hole in the bar with one of a plurality of holes in the cam and then inserting a pin through the aligned holes. Once the bar is placed in a desired starting position, it may be moved in either a first or a second direction to rotate the cam against the provided resistance in a corresponding first or second rotational direction about the cam's pivotal mounting point.

In a principle embodiment of the present invention, a first handlebar is releasably coupled to a cam located generally above and behind a seat mounted to the frame, and a second crossbar and arm assembly is releasably coupled to a cam located generally beneath the seat. Each cam has an associated resistance means coupled between it and the frame of the exercise machine. Accordingly, an exercise machine is provided which permits the user to engage and move a moveable means with various portions of his or her body for performing physical exercises.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
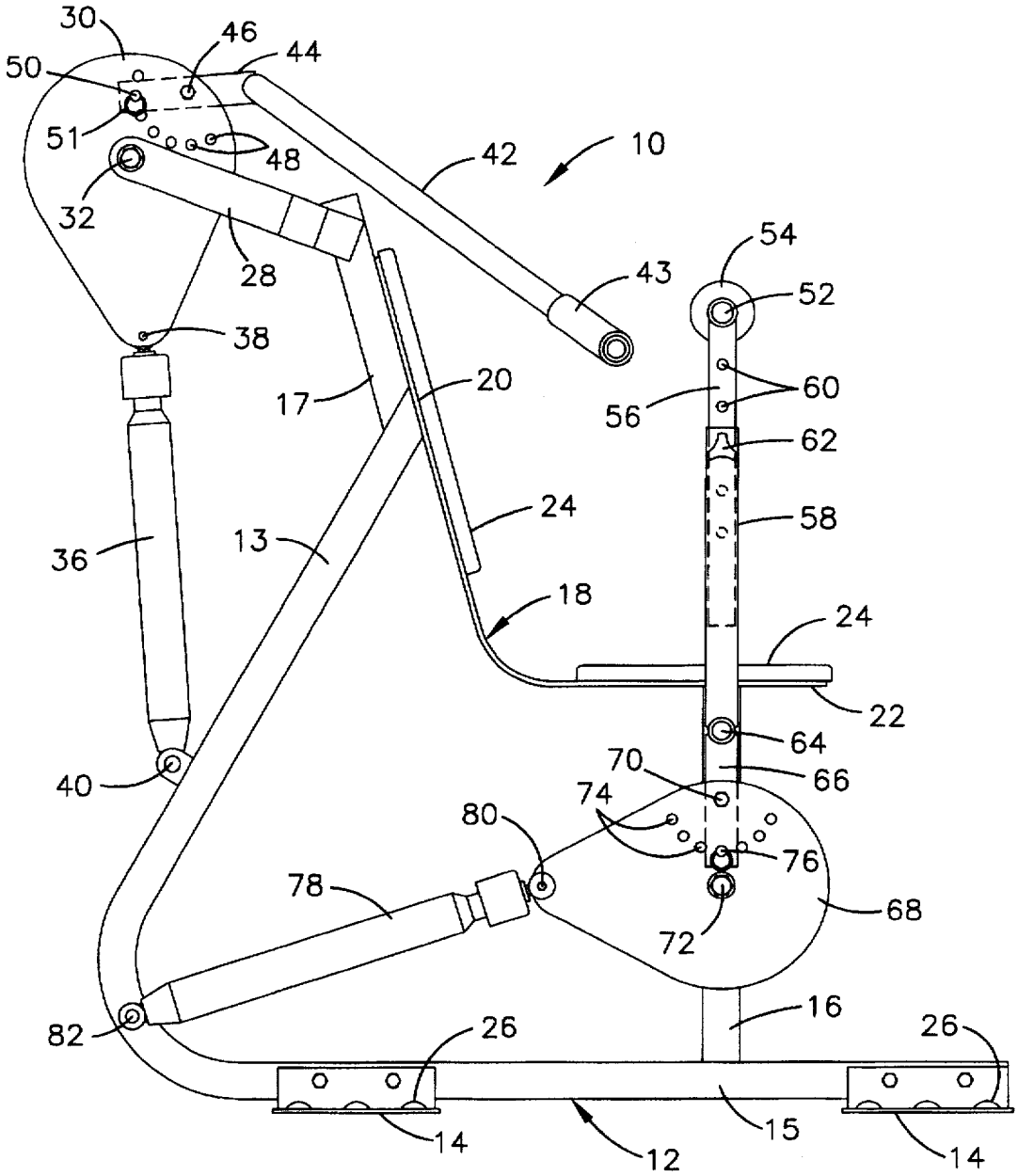
FIG. 1 is a left side elevational view of the preferred embodiment of the exercising machine of the present invention.
Figure 2:
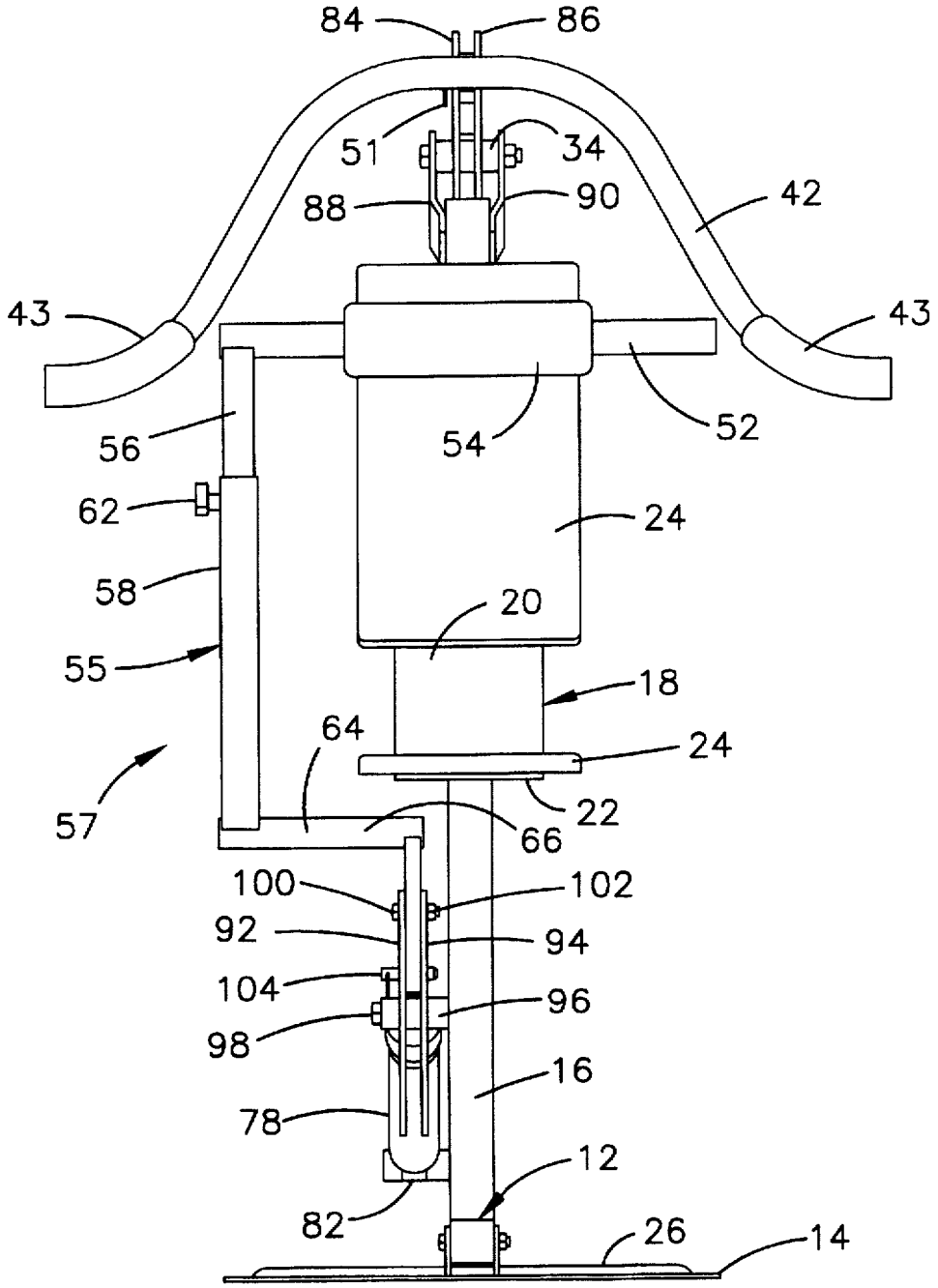
FIG. 2 is a front elevational view thereof.
Figure 3:
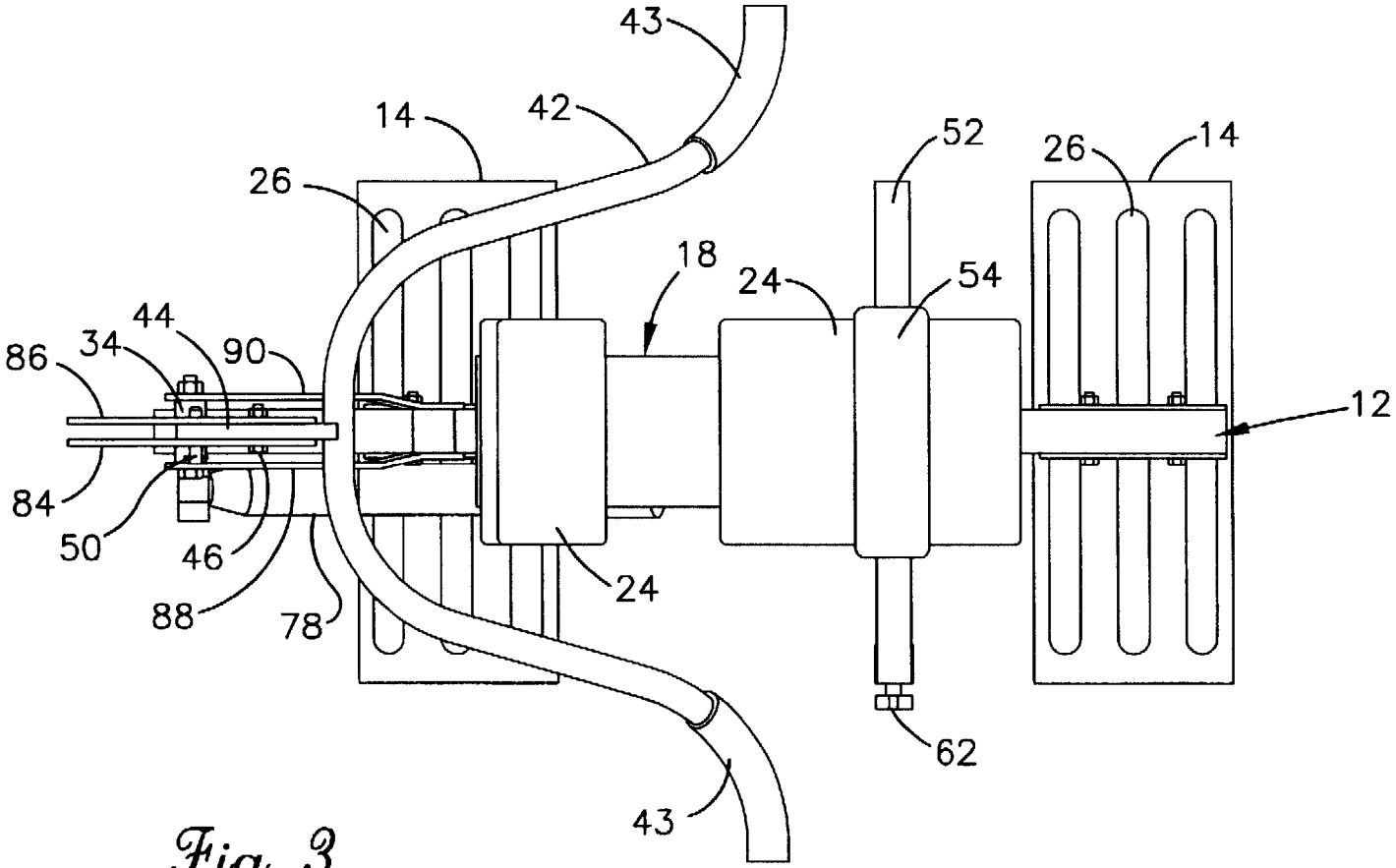
FIG. 3 is a top plan view thereof.

With reference initially to FIGS. 1–3, the preferred embodiment of the exercise machine of the present invention, generally denoted by the reference numeral 10, is described. Exercise machine 10 has a frame which may be constructed in a variety of manners. Preferably, the frame comprises a main support member 12, feet members 14 connected to said main support member 12 and for engaging the floor, and an upright beam 16 extending upwardly from said main support member 12. As shown, main support member 12 is preferably shaped substantially like a "V", lying on its side. A seat 18 is mounted on said frame and is preferably comprised of one piece of material bent to form seat 18. Particularly, seat 18 has a backrest portion 20 for engaging with upwardly extending leg 13 of base support member 12 and a seat portion 22 for engaging upwardly extending beam 16 of the frame of exercise machine 10. Cushions 24 are provided on seat 18. Feet members 14 preferably have upwardly extending ridges 26 for providing traction to a user of machine 10 standing thereon while performing one of various physical exercises.

The frame of exercise machine 10 further comprises a bracket 28, extending from upper frame member 17, in a direction above and behind seat 18. A cam 30 is pivotally mounted to bracket 28 at a pivot position 32. As shown in FIG. 2, cam 30 is coupled to bracket 28 at pivot position 32 by axle 34 held in place by a nut and bolt. It will be appreciated that the pivotal connection between cam 30 and bracket 28 may be accomplished in a variety of manners.

A handlebar 42, having foam handgrips 43 thereon, is connected to cam 30. Particularly, handlebar 42 has a connecting member 44 extending from substantially a central location of handlebar 42 to engage with cam 30. Handlebar 42 is connected to cam 30 at a pivot location 46 on connecting member 44. Handlebar 42 may thus be pivoted about pivot position 46 relative to cam 30. A plurality of apertures 48 extend through cam 30 from one side of cam 30 to its other side. Apertures 48 form an arcuate array of holes about pivot location 46 of handlebar 42. These apertures 48 provide means for releasably coupling handlebar 42 in one of a plurality of fixed resting positions. Specifically, a pin 50 is inserted through an aperture (not shown) in connecting member 44 and a selected aperture 48 in cam 30 to selectively position handlebar 42 in one of the plurality of fixed resting locations.

It will be appreciated that the assembly shown and described for connecting the handlebar in one of a plurality of fixed resting positions may be constructed in a variety of ways. For instance, it is contemplated that the pivot position 46 of handlebar 42 be located at pivot position 32 of cam 30. In such an embodiment, an array of apertures 48 is located on cam 30 such that they form an arc about the pivot position. Particularly, the arc in such an embodiment is inverted with respect to the arc shown in FIG. 1 and the apertures 48 are positioned substantially near the outer peripheral edge of cam 30. It will be further appreciated that the location of pivot position 32 of cam 30, the location of pivot position 46 of handlebar 42, and the location of apertures 48 may be varied without departing from the principles and objects of the present invention.

A piston 36 is connected at a first end thereof to a position 38 on cam 30. The piston 36 is connected at its opposite end to main support member 12 and particularly upwardly extending leg portion 13 of main support member 12. More specifically, piston 36 is attached at a second end thereof to the frame at a position 40. In this regard, upwardly extending leg portion 13 of main support member 12 is preferably aligned at an acute angle to and in an overlying relationship with respect to at least a portion of the horizontal leg forming the base portion 15 of main support member 12. As will be described in greater detail below, positions 38 and 40 are pivotal connections.

Figure 8:
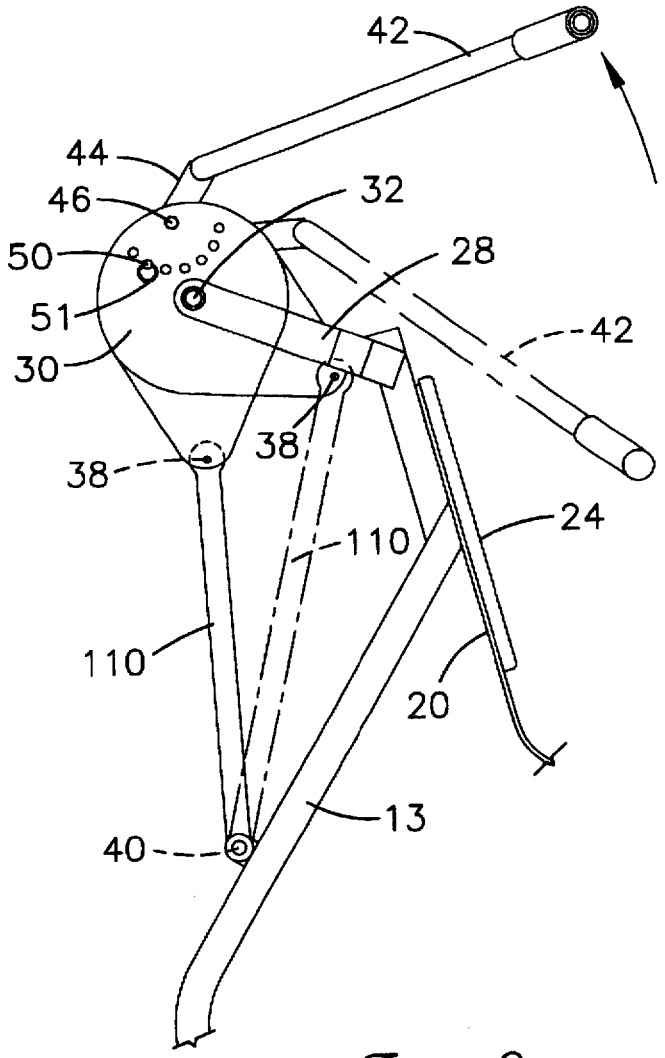
FIG. 8 shows a portion of the exercise machine of the present invention having a stretchable band, including broken lines for illustrating operation.

As described more fully below, piston 36 is a means for resisting rotation of cam 30. It should be understood that other means for resisting rotation may be substituted in place of piston 36. For instance, as shown in FIG. 8, an elastomeric strap or band 110 may be attached between base support member 12 and cam 30. It will be appreciated that, in such an embodiment, rotation of cam 30 will be against the resistance of the elastic band 110 or strap such that the band or strap will stretch as cam 30 is rotated from its resting position. Alternatively, a cable or chain may be attached to cam 30 at one end thereof, with the opposite end of the cable being attached to a weight assembly. In such an embodiment, it will be appreciated that rotation of the cam will draw the cable and lift the weight assembly from a resting position.

In the preferred embodiment of the present invention, the entire assembly comprised of upper frame member 17, bracket 28, cam 30, handlebar 42, and piston 36 may be removed from machine 10. Particularly, upper frame member 17 is bolted (not shown) or otherwise releasably attached to machine 10, and particularly, is bolted to upwardly extending portion 13 of the frame of machine 10. Additionally, piston 36 may be easily disconnected from upwardly extending portion 13 of main support member 12 of machine 10.

In addition to the components just described, a crossbar assembly 57 for performing various physical exercises is provided having a crossbar 52 generally disposed over seat portion 22. Crossbar 52 has a pad 54 positioned around it. Crossbar 52 is connected to an adjustable arm assembly 55. Arm assembly 55 is comprised of a first beam 56 in telescopic relationship with a second beam 58. First beam 56 has a plurality of holes 60 forming a row along a portion of its length. The position of crossbar 52 is adjustable by altering the depth to which first beam 56 is inserted within the hollow interior of second beam 58 and placing a pin 62 through an aperture (not shown) in second beam 58 and one of the apertures 60, of first beam 56, in alignment therewith. Arm assembly 55 further comprises a shoulder portion 64. Shoulder portion 64 is connected at one end thereof to second beam 58 of arm assembly 55 and at the other end thereof to a connecting beam element 66. Connecting beam element 66 engages a cam 68 thereby operably connecting crossbar 52 and arm assembly 55 with cam 68. Specifically, connecting beam element 66 is pivotally attached to cam 68 at pivot position 70.

Cam 68 is pivotally attached to the frame of exercise machine 10, and particularly, is pivotally attached at pivot position 72 to upwardly extending member 16. The preferred construction and arrangement of cam 72 resembles that as described above with reference to cam 30. Specifically, a plurality of apertures 74 are provided in an arc-wise relationship relative to pivot position 70. A pin 76 positioned through a selected aperture 74 of cam 72 and an aperture (not shown) near the end of connecting beam element 66 permits crossbar 52 to be positioned in one of a plurality of fixed resting positions. As indicated above with reference to cam 30, it will be appreciated that the locations of pivot position 70, pivot position 72, and apertures 74 may be varied without departing from the spirit and scope of the present invention.

A piston 78 is connected between cam 68 and main support member 12 of exercise machine 10. Specifically, piston 78 is pivotally coupled to cam 68 at a first end of piston 78 at pivot position 80. Piston 78 is pivotally connected at its opposite end to main support member 12 at pivot position 82. Preferably, pivot position 82 is located at a curved portion of main support member 12 generally between base portion 15 and upwardly extending portion 13. As discussed above, it will be understood that piston 78 is for providing resistance to rotation of cam 68. Other resisting means, such as elastomeric straps or bands, or a cable connected with a weight assembly to be lifted may be utilized in accordance with the principles of the present invention.

With reference now to FIGS. 2 and 3, it is seen that cam 30 is preferably comprised of a first portion 84 spaced apart from a second portion 86. Connecting member 44 of handlebar 42 is adapted for insertion between portions 84, 86. Additionally, as shown, bracket 28 comprises a first portion 88 and a second portion 90 extending about opposite sides of cam 30. As shown in FIG. 3, pin 50 extends through first and second portions 84, 86 of cam 30 and connecting member 44 for locking handlebar 42 in one of a plurality of fixed resting positions. Additionally, it is seen in FIG. 3 that pivot location 46 preferably comprises a nut and bolt for pivotally attaching handlebar 42 to cam 30. It is also noted that a small ring 51 for grasping is provided on pin 50.

As shown in FIG. 2, cam 68 is preferably constructed in the same manner as cam 30 such that a first cam portion 92 is connected to, and spaced apart from, a second portion 94. Connecting beam element 66 is inserted between portions 92, 94. Pivot position 72 pivotally connecting cam 68 to upwardly extending member 60 is comprised of an axle 96 held in place by a bolt 98. Connecting member 66 is pivotally attached to cam 68 by insertion of a nut 100 through first and second cam portions 92, 94 and connecting element 66. A bolt 102 holds nut 100 in place. A pin 104 is inserted through a selected one of the apertures 74 in cam 68 and an aperture (not shown) in connecting member 66 to secure arm assembly 55 and its crossbar 52 in one of a plurality of fixed resting positions. It will be understood that the cams utilized in accordance with the present invention are provided with apertures in each portion thereof such that an aperture in one portion of a cam has an associated aperture in alignment therewith in the second portion thereof.

Additionally, as shown, cams 30, 68 are preferably teardrop shaped. Each pivot location 32, 72 is preferably positioned in a substantially central location with respect to the periphery of the primarily circular portion of its respective cam. The point at which each piston 36, 78 connects with its respective cam, namely the position 38 and the position 80, is preferably substantially near the end of the elongated portion of the cam. It should be understood that cams 30, 68 may be formed of other geometrical configurations without departing from the principles of the present invention. For instance, a circular or polygonal plate, or a bar or beam could be utilized. Furthermore, the location of the pivot point of a cam or the location at which its associated piston or other resistance means connects with the cam may be varied without departing from the principles of this invention. Accordingly, it will be appreciated that the cams utilized in accordance with the present invention are rotatable means for rotating against the resistance of resistance means which are operably connected with the cam, whereby rotation of the cam occurs upon the application of a sufficient force on a bar attached to the cam.

With reference to FIGS. 4–7, operation of the present invention is described. Particularly, each cam arrangement utilized in accordance with the principles of the present invention is pivotally mounted to the exercise machine 10 such that it may be rotated from its resting position against resistance and about its pivot position in either a clockwise or counter-clockwise direction. Accordingly, it is a principle feature of the present invention to releasably engage a moveable element for use while exercising in one of a plurality of fixed resting positions thereby permitting exercise machine 10 to be utilized for performing a variety of physical exercises. Additionally, as set forth above, upper frame member 17 may be removed from machine 10 along with bracket 28, cam 30, handlebar 42 and piston 36.

Figure 4:
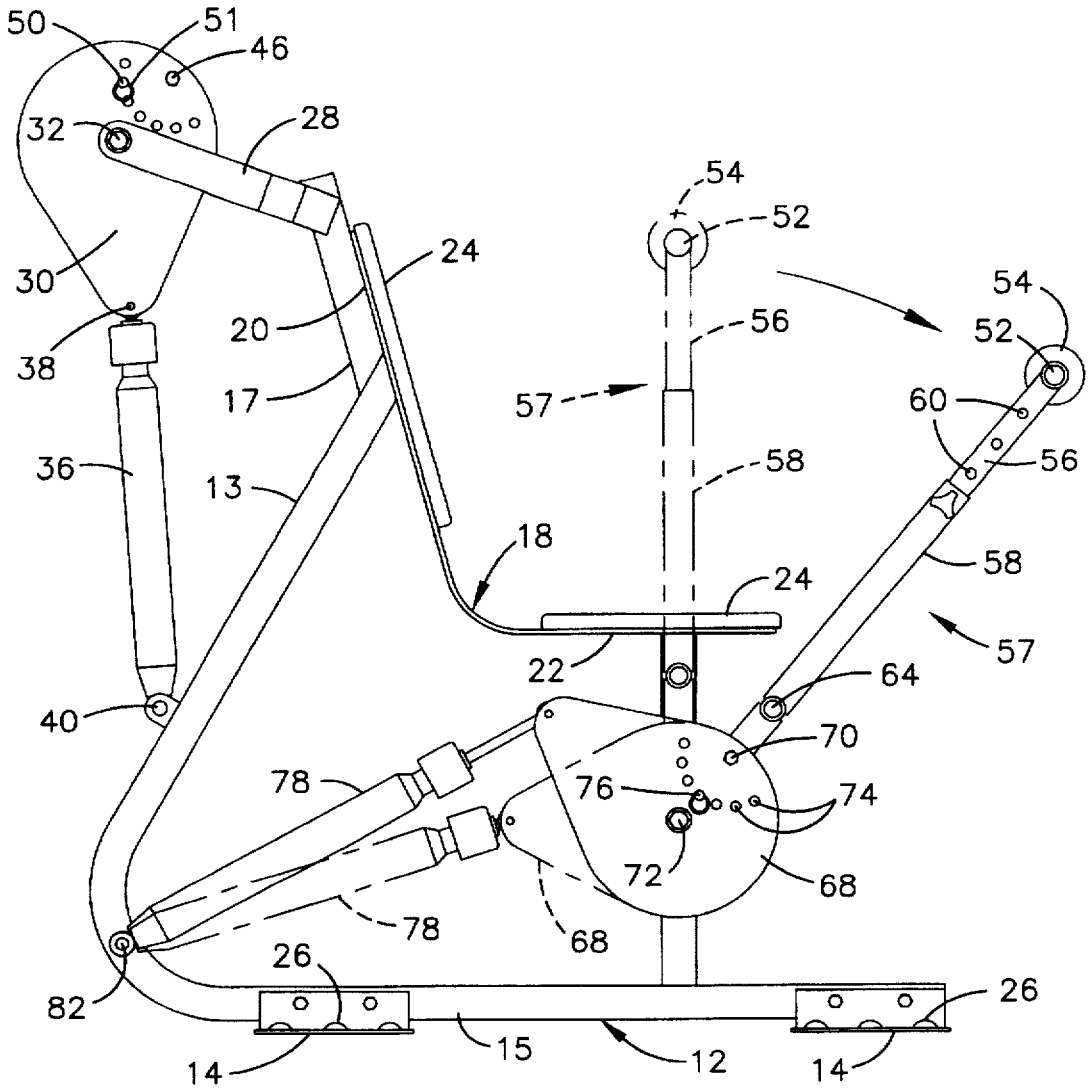
FIG. 4 is a left side elevational view thereof showing the exercising machine in one mode of operation, including broken lines for illustrating movement of various components.
Figure 5:
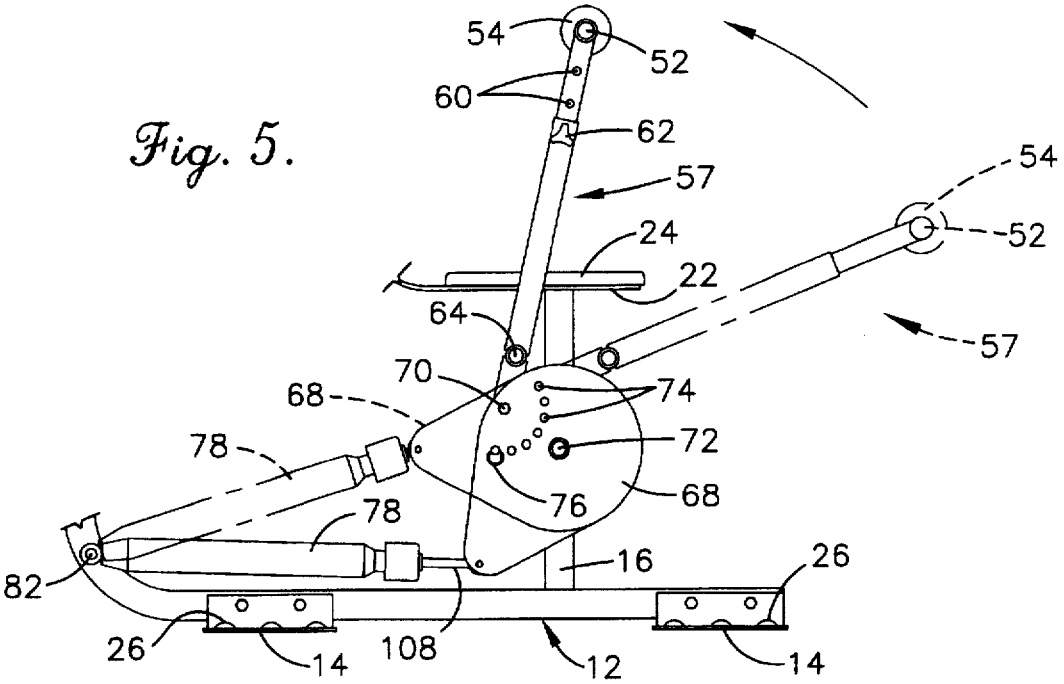
FIG. 5 is a right side elevational view of a portion of the exercising machine showing the exercising machine in a different mode of operation, including broken lines for illustrating component movement.

With reference to FIGS. 4 and 5, operation of crossbar 52 and the cam 68 and piston 78 to which crossbar 52 is operably connected is described. As shown in FIG. 4, handlebar 42 has been removed. This can be easily accomplished by removing a nut and bolt at pivot position 46 and also removing pin 50 thereby releasing all connection of handlebar 42 from cam 30. It should also be appreciated that removal of handlebar 42 is not necessary to perform exercises with crossbar 52.

As shown in FIG. 4, crossbar 52 is placed in a selected resting position as indicated by broken lines. Selection of a resting position is accomplished by rotating crossbar assembly 57 about pivot position 70 until crossbar 52 is at a preferred position and an aperture near the end of connecting member 66 of crossbar assembly 57 is in alignment with an appropriate, selected aperture 74 in cam 68. Pin 76 is then placed through the aligned apertures to hold crossbar assembly 57, and hence its crossbar 52, in the desired resting position. The ability of cam 72 to pivot in either direction about its pivot position 72 allows the crossbar assembly 57 to be moved by a user from its resting position shown by broken lines in FIG. 4 either in the direction of the arrow, or alternatively, in a direction from its resting position opposite that of the arrow towards backrest portion 20 of seat 18. It is apparent that the direction of movement depends upon the position of the user and the nature of the exercise being performed.

In the illustration shown in FIG. 4, crossbar assembly 57 is moved from its selected resting position in the direction of the arrow as shown. Particularly, such movement is accomplished by an individual performing an exercise and applying force against crossbar 52 in the direction indicated. As crossbar assembly 57 moves in response to a sufficient force applied against crossbar 52, cam 68 rotates. As shown, movement of crossbar assembly 57 from its resting position shown in broken lines to the position shown in solid lines causes cam 68 to rotate about its pivot position 72 and from its resting position shown in broken lines. As cam 68 rotates, the piston 78 attached thereto is actuated. Particularly, piston 78 is moved from its resting position, shown in broken lines, and a rod 108, which is part of the piston 78, is drawn from the piston chamber. Normal piston operation will be readily appreciated by those skilled in the art. Particularly, piston 78 provides resistance to rotation of cam 68. In this regard, forcing rod 108 from its piston chamber requires a sufficient, preselected force. As illustrated in FIG. 4, piston 78 pivots with respect to cam 68 at its pivot location 80 and with respect to the frame, and particularly main support member 12, at its pivot location 82.

In one preferred embodiment of the present invention, piston 78 is spring-loaded such that removal of the force sufficient to move or hold crossbar assembly 57 from its resting position will cause the piston, and hence the cam 68 and crossbar assembly 57, to return to its resting position.

FIG. 5 illustrates operation of the present invention with crossbar assembly 57 positioned in a selected fixed resting position different from that illustrated in FIG. 4. The resting position of crossbar assembly 57 is indicated by broken lines. Again, placement of crossbar assembly 57 in the selected resting position shown is accomplished by rotating crossbar assembly 57 about pivot position 70 until the aperture near the end of connecting member 66 is aligned with a selected aperture 74 of cam 68. Pin 76 is then placed through the aligned apertures. During the performance of a physical exercise, application of a sufficient force against crossbar 52 causes crossbar assembly 57 to move in the direction of the arrow. As described above with reference to FIG. 4, such movement of crossbar assembly 57 causes cam 68 and piston 78 to move from their resting positions indicated by broken lines. However, in contrast to the operation described with respect to FIG. 4, movement of crossbar assembly 57 in the direction indicated in FIG. 5 causes cam 68 to rotate about its pivot position 72 against the resistance provided by piston 78 in a direction opposite that described with reference to FIG. 4.

Accordingly, crossbar assembly 57 may be utilized to perform a variety of physical exercises by placing crossbar assembly 57 in one of a plurality of fixed resting positions and then moving crossbar assembly 57 against the resistance provided by piston 78. In accordance with primary principles of the present invention, the pivotal ability of cam 68 permits bi-directional movement of crossbar assembly 57 from any selected resting position against the resistance of piston 76.

Accordingly, it will be appreciated that a user of machine 10 may perform multiple physical exercises with crossbar assembly 57. For instance, crossbar 52 may be pushed, pulled, lifted, or pressed from any selected fixed resting position by a user engaging crossbar 52 with a portion of his or her body. In this regard, it will be appreciated that exercises may be performed with crossbar assembly 57 by a user seated in seat 18 or standing in an appropriate position to engage crossbar 52 in any one of a variety of ways. Additionally, it will be appreciated that crossbar 52 is adapted to be positioned for engagement by various portions of the body of an individual performing exercises, such as the hands, arms, shoulders, neck, chest and stomach, back, legs, etc.

Figure 7:
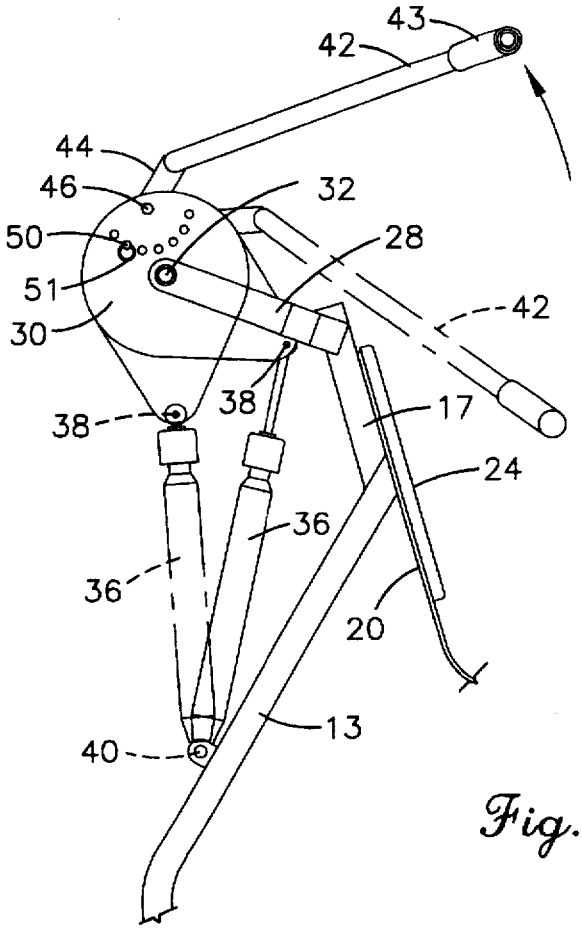
FIG. 7 shows a portion of the exercise machine of the present invention, including broken lines for illustrating another mode of operation.
Figure 6:
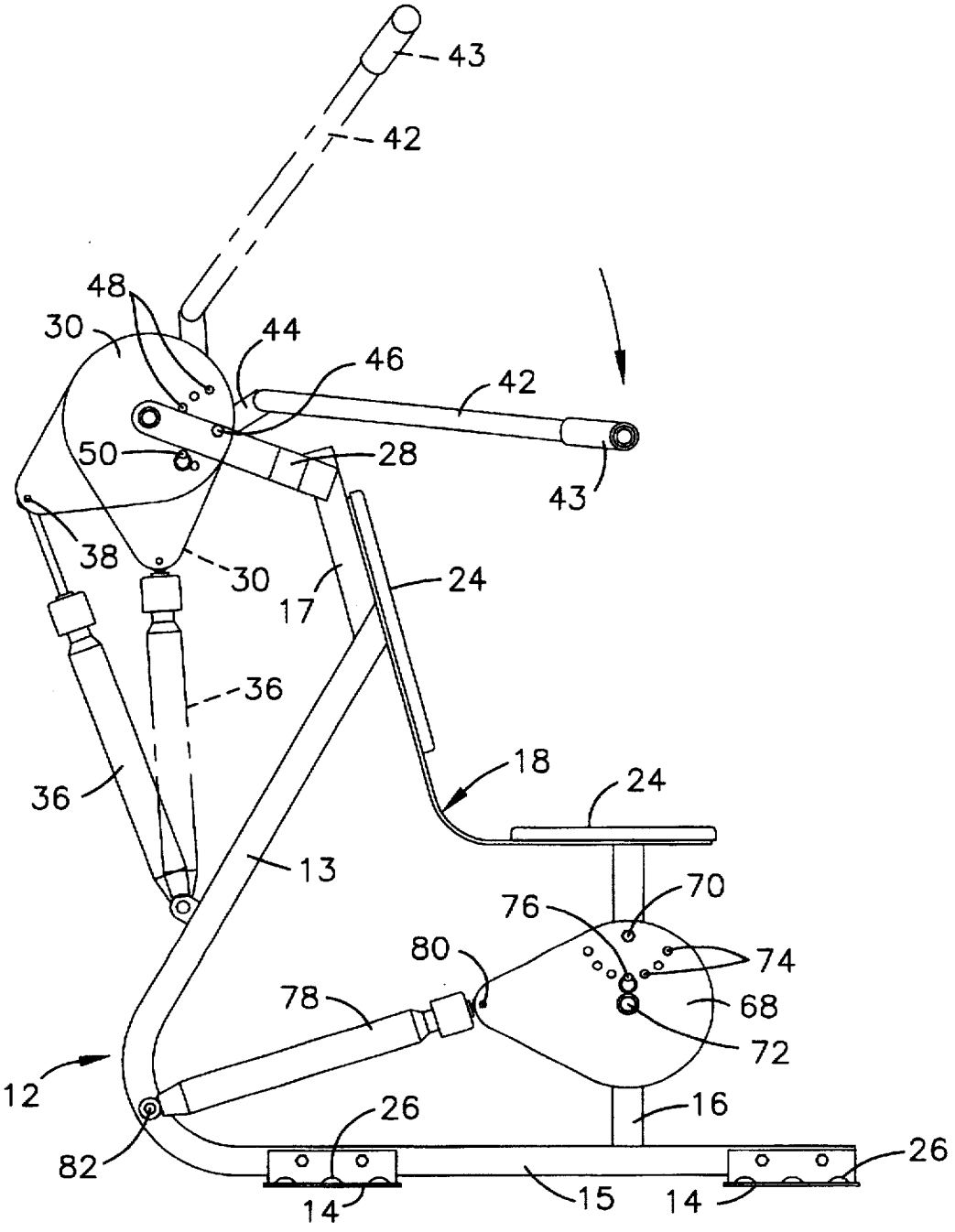
FIG. 6 is a right side elevational view of the exercising machine of the present invention, including broken lines for illustrating one mode of operation.

Referring now to FIGS. 6 and 7, operation of handlebar 42, cam 30, and piston 36 while machine 10 is in use is described. As shown in FIG. 6, crossbar assembly 57 has been removed. With reference to FIG. 2, removal of crossbar assembly 57 is easily accomplished by removing the nut and bolt assembly 100, 102, and pin 104. Alternatively, crossbar 52 and first arm member 56 may be removed, while leaving the remaining portion of crossbar assembly 57 in place, by removing pin 62 and sliding first arm member 56 from second arm member 58. It should be understood that while crossbar assembly 57 may be disassembled in the manner described, it is not necessary to remove the components of crossbar assembly 57 to perform exercises with handlebar 42.

The principles of operation of handlebar 42, cam 30, and piston 36 are the same as those described above with reference to FIGS. 4 and 5. Particularly, handlebar 42 may be placed in one of a plurality of fixed resting positions by aligning the aperture near the end of connecting member 44 with a selected aperture 48 in cam 30 and placing pin 50 therethrough to lock handlebar 42 in place. FIG. 6 illustrates operation of machine 10 when handlebar 42 is placed in a selected resting location, as illustrated by broken lines, and moved in the direction of the arrow. Movement of handlebar 42 from its resting position in this first, clockwise direction causes the cam 30 to likewise pivot in a clockwise direction about its pivot position 32. As cam 30 rotates, the point at which piston 36 is attached to cam 30, namely position 38, is moved from its resting position, shown in broken lines, to the extended position shown in solid lines. Accordingly, movement of handlebar 42, and hence rotation of cam 30, is against the resistance provided by piston 36. As cam 30 rotates, piston 36 pivots at its pivot positions 38, 40.

With reference to FIG. 7, a mode of operation of handlebar 42, cam 30, and piston 36 is illustrated whereby handlebar 42 is moved from a resting position in a direction generally opposite that described with reference to FIG. 6. Particularly, in the illustration of FIG. 7, handlebar 42 begins in a fixed resting position as indicated by broken lines and is moved by a user while performing a physical exercise in the general direction indicated by the arrow. As handlebar 42 is moved generally in this second, counter-clockwise direction, and opposite the general direction indicated by the arrow in FIG. 6, cam 30 pivots about its pivot position 32 in a counter-clockwise direction—a rotational direction opposite to that described with reference to the operation of FIG. 6. Accordingly, movement of handlebar 42 as shown in FIG. 7 causes cam 30 to rotate against the resistance of piston 76 as will now be apparent from the foregoing description.

Handlebar 42 may be placed in a plurality of fixed resting positions and moved from its selected resting position, by a user while performing a physical exercise, in either a first direction or a second direction opposite that of the first direction. It will now be understood in view of the foregoing description that movement of the handlebar 42 from a selected, fixed resting position in a first direction will cause cam 30 to rotate in a first direction against the resistance of piston 36, while movement of handlebar 42 from a selected, fixed resting position in a second direction, opposite that of the first direction, will cause cam 30 to rotate in a corresponding second direction against the resistance of piston 36.

As described above, pistons 36 and 78 operate to provide resistance to rotation of cams 30, 68, respectively, in first and second directions. It will be appreciated by those skilled in the art that such operation is consistent with a single-action piston assembly whereby it requires a predetermined force to extend the piston, and in the absence of that force, the piston will return to its resting position. However, it will be appreciated that various possible piston arrangements are contemplated and within the scope of the present invention. For instance, a single-action piston could be arranged such that rotation of a cam to a first position may be accomplished with no significant resistance from the piston, while the piston operates to resist movement of the cam to a second position.

Additionally, one preferred embodiment of the present invention provides pistons 36, 78 that are capable of operating in a dual-action mode. Such pistons are known to those skilled in the art. A dual-action piston operates such that both extension of the piston and retraction of the piston requires a predetermined force to be applied to the piston. Accordingly, use of a dual-action piston in accordance with the present invention permits one of the moveable means for engaging by the user (i.e., a handlebar 42 or a crossbar 52, etc.) to be placed in a selected, fixed starting position and moved in either direction against the resistance of its respective piston 36, 78. Then, movement of the moveable means back to its starting position is also against the resistance of its respective piston 36, 78. It has been found that utilization of machine 10 with pistons 36, 78 in a single-action mode permits a user to perform a variety of anaerobic exercises for strength training and conditioning purposes. Additionally, it has been found that exercise machine 10 provides an excellent aerobic workout when pistons 36, 78 are dual-action pistons.

Additionally, as described above, it will be appreciated that pistons 36, 78 for providing resistance for rotation of cams 30, 68, respectively, may be substituted with other known resistance means. For instance, one or more elastomeric straps or bands may be fixedly attached between the cams and the frame of exercise machine 10. Utilization of elastomeric straps and bands are known to the art, and it will be appreciated that the present invention is one that is well adapted to use such straps or bands, and other similar resistance bands. Additionally, a cable or chain may be provided such that a first portion of the cable engages with a cam and a second portion of the cable engages with a weight assembly, whereby movement of the cam causes the cable to be drawn and the weight assembly to lift from a resting position. Further, it is contemplated that electromagnetic resistance devices may be utilized.

It will further be understood by those skilled in the art that the amount of resistance provided by pistons 36, 78 may be easily adjusted in accordance with the operating principles of known piston assemblies. Additionally, elastomeric straps and bands, and other resistance devices, are available for providing a variety of resistances.

From the foregoing it will be seen that this invention is one well-adapted to attain all ends and objects hereinabove set forth together with the other advantages which are obvious and inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An exercise apparatus comprising:

a frame;

extendable resistance means coupled between said cam and said frame for applying a desired force against extension of said resistance means;

a cam pivotally mounted with respect to said frame at a first location on said cam;

a movable member, for engagement by the user while exercising, pivotally mounted to said cam at a second location on said cam; and means for releasably attaching said movable member with said cam in one of a plurality of fixed resting positions, whereby movement of said movable member from a fixed resting position causes said cam to pivot thereby actuating said resistance means;

wherein said resistance means is operably connected with said cam to resist movement of said movable member in either direction from the resting position thereof.

2. The apparatus as set forth in claim 1 wherein said resistance means comprises a piston.

3. The apparatus as set forth in claim 1 wherein said extendable resistance means is a piston pivotally attached at one end thereof to said frame and at an opposite end thereof to said cam.

4. The apparatus as set forth in claim 3 wherein said piston is a single-action piston.

5. The apparatus as set forth in claim 3 wherein said piston is a dual-action piston, wherein said dual-action piston resists rotation of said cam and further resists rotation of said cam back to said starting position.

6. The apparatus as set forth in claim 1 wherein said extendable resistance means comprises an elastomeric band.

7. The apparatus as set forth in claim 6 wherein said elastomeric band is connected at a first portion thereof to said rotatable element and at a second portion thereof to said frame.

8. An apparatus as set forth in claim 1, wherein said frame is constructed as a V-shaped structure.

9. An apparatus as set forth in claim 1, further comprising:

a seat and backrest for supporting a user;

said frame having a singular horizontal leg forming a base portion and a singular upwardly extending leg, said upwardly extending leg having an outer end supportably secured to one side of said backrest;

an upwardly extending member secured to and protecting upward from said horizontal leg, said upwardly extending member having an upper end supportably secured to one side of said seat, wherein said upwardly extending leg is aligned at an acute angle to said horizontal leg and in an overlapping relation therewith.

10. An apparatus as set forth in claim 1, further comprising:

a seat and backrest for supporting a user;

said frame having a singular horizontal leg forming a base portion and an upwardly extending leg, said upwardly extending leg having an outer end supportable secured to one side of said backrest;

a singular upwardly extending member secured to and projecting upward from said horizontal leg, said upwardly extending member having an upper end supportably secured to one side of said seat, wherein said horizontal and upwardly extending legs join at a bend to form said frame in a V-shaped structure, said resistance means having one end secured to said frame proximate said bend.

11. An apparatus as set forth in claim 1, further comprising a seat and a backrest on said frame, wherein said cam includes first and second rotatable members and said moveable member includes first and second bars that are selectively secured to a corresponding one of said first and second cams, said first cam and bar being located proximate an upper end of said backrest, said second cam and bar being located proximate said seat.

12. An apparatus as set forth in claim 11, wherein, said resistance means comprises first and second resistance means corresponding to said first and second cams, respectively, wherein each of said cams is rotatable in both directions against the resistance of said corresponding resistance means.

13. An apparatus as set forth in claim 1, wherein said moveable member includes a handlebar that is selectively secured to said cam.

14. An apparatus as set forth in claim 1, said apparatus further comprising:

a seat and backrest for supporting a user;

said frame having a horizontal leg forming a base portion and an upwardly extending leg, said upwardly extending leg having an outer end supportably secured to one side of said backrest;

an upwardly extending member secured to and projecting upward from said horizontal leg, said upwardly extending member having an upper end supportably secured to one side of said seat, wherein said seat and backrest are provided upon a unitary support structure mounted upon an outer end of said upwardly extending leg proximate an intermediate point along said backrest, said support structure being secured to said upper end of said upwardly extending member at an intermediate point along said seat.

15. An exercise apparatus as set forth in claim 1 wherein said cam comprises an elongate second portion integrally formed with said enlarged first portion.

16. An exercise apparatus as set forth in claim 1 wherein, when said movable member is in said resting position, said cam and said extendable resistance means are each in a corresponding resting position, and whereupon movement of said movable member, in either a first or a second direction from its resting position, rotates said cam, from its resting position, causing said extendable resistance means to be extended against said desired force, thereby providing a desired force against movement of said moveable member, from its said resting position, in either a first or a second direction.

17. An apparatus as set forth in claim 1, further comprising a seat and a backrest on said frame, wherein said cam is located immediately below said seat and further comprising a second cam located proximate an upper end of said backrest.

18. An apparatus as set forth in claim 1, further comprising a seat and a backrest on said frame, wherein said cam is located proximate said seat and further comprising a second cam and a second resistance means located proximate an upper end of said backrest.

19. An exercise apparatus comprising:

a frame;

a seat and a backrest, said seat and backrest located on said frame;

a first cam pivotally mounted in relation to said frame at a first location on said first cam proximate an upper end of said backrest;

a first bar, having gripping areas at outer ends thereof, adapted to be moved for exercising, said first bar being pivotally mounted at a second location on said first cam;

first extendable resistance means, coupled between said first cam and said frame, for applying a desired force against extension of said first resistance means, thereby resisting rotation of said first cam;

a second cam pivotally mounted in relation to said frame at a first location on said second cam proximate a bottom side of said seat;

a second bar adapted to be moved for exercising, said second bar being horizontally disposed in relation to said frame, selectively positionable to a rest position over said seat, and pivotally mounted at a second location on said second cam;

second extendable resistance means, coupled between said second cam and said frame, for applying a desired force against extension of said second resistance means, thereby resisting rotation of said second cam; and first and second attaching means, associated with said first and second cams, respectively, for selectively attaching said first bar and said second bar to said first cam and said second cam, respectively, in one of a plurality of fixed resting positions, wherein each said cam is rotatable in first and second directions from a starting position associated with a selected fixed resting position of its corresponding bar, against the resistance of said first and second extendable resistance means, respectively, by moving said first and second bar, respectively, from its starting position in either said direction.

20. The apparatus as set forth in claim 19 wherein said first and second rotatable elements each have an enlarged first portion and an elongate second portion integrally formed therewith and wherein said first and second attaching means comprise first and second arrays of apertures located in said first portion of said first and second rotatable elements, respectively.

21. An exercise apparatus as set forth in claim 19 wherein said first and second extendable resistance means each comprises a piston.

22. An exercise apparatus as set forth in claim 19 wherein said first and second extendable resistance means each comprises an elastomeric band.

23. An exercise apparatus comprising:

a frame;

a cam pivotally mounted in relation to said frame at a first point located at or proximate the center of said cam;

a movable bar, engagable by a user while exercising, said movable bar being pivotally mounted to said cam at a second point on said cam and further being selectively secured to said cam in one of a plurality of fixed resting positions; and extendable resistance means, coupled between said frame and a third point on said cam, for applying a desired force against extension of said resistance means, wherein, upon movement of said bar in either a first or a second direction from its selected resting position, said cam is rotated in a corresponding first or second direction, thereby causing said extendable resistance means to extend against said desired force, and thus providing a desired force against movement of said movable bar, from its selected resting position, in either direction.

24. The exercise apparatus as set forth in claim 23 wherein said extendable resistance means comprises a piston.

25. The exercise apparatus as set forth in claim 23 wherein said extendable resistance means comprises an elastomeric band.

26. The exercise apparatus as set forth in claim 23 wherein said third point on said rotatable element is at a peripheral edge thereof.

* * * * *